United States Patent [19]

Ota

[11] 4,397,565

[45] Aug. 9, 1983

[54] ELECTRONIC TIMEPIECE INCLUDING AN ANIMATED DISPLAY

[75] Inventor: Tomio Ota, Suwa, Japan

[73] Assignee: Kabushiki Kaisha Suwa Seikosha, Tokyo, Japan

[21] Appl. No.: 204,973

[22] Filed: Nov. 7, 1980

[30] Foreign Application Priority Data

Nov. 9, 1979 [JP] Japan ..... 54-145180

[51] Int. Cl.[3] ..... G04C 17/00; G04C 19/00

[52] U.S. Cl. ..... 368/242; 368/229; 368/223

[58] Field of Search ..... 368/82–84, 368/239–242, 66, 72, 73, 203–205, 256, 232, 229, 10; D10/6, 7, 8, 15, 33, 34, 35; 40/427, 448, 907; 340/784

[56] References Cited

U.S. PATENT DOCUMENTS

| | | | |
|---|---|---|---|
| D. 184,355 | 2/1959 | Judson | D10/34 X |
| 2,689,424 | 9/1954 | Clagett | 40/427 |
| 3,576,364 | 4/1971 | Zanoni | 340/784 |
| 3,744,235 | 7/1973 | Kratomi | D10/15 X |
| 3,802,182 | 4/1974 | Fujita | 368/84 |
| 3,898,790 | 8/1975 | Takamune et al. | 368/82 X |
| 3,971,205 | 7/1976 | Nomura et al. | 368/82 |
| 4,081,952 | 4/1978 | Busch et al. | 368/82 |
| 4,216,649 | 8/1980 | Ichikawa et al. | 368/10 |

FOREIGN PATENT DOCUMENTS

| | | | |
|---|---|---|---|
| 2403383 | 8/1974 | Fed. Rep. of Germany | 368/84 |
| 54-136868 | 10/1979 | Japan | 368/239 |

*Primary Examiner*—Bernard Roskoski

*Attorney, Agent, or Firm*—Blum, Kaplan, Friedman, Silberman & Beran

[57] ABSTRACT

An electronic timepiece with an animated display is provided. The animated display includes flickering display elements for providing the animation. The timepiece includes a timekeeping circuit for generating actual time signals in at least hours and minutes and a corresponding time display region for displaying time in response to the time signals generated by the timekeeping circuit. The flickering animated display elements are driven independently of the timekeeping display.

A digital display timepiece may include the animated display elements within a picture pattern. In this case, the flickering display elements form a part of the pattern. In a liquid crystal display timepiece, the flickering display elements may comprise portions of segments of display terminals and may be driven in response to seconds signals generated by a seconds counter of the timekeeping circuit.

11 Claims, 9 Drawing Figures

FIG. 4
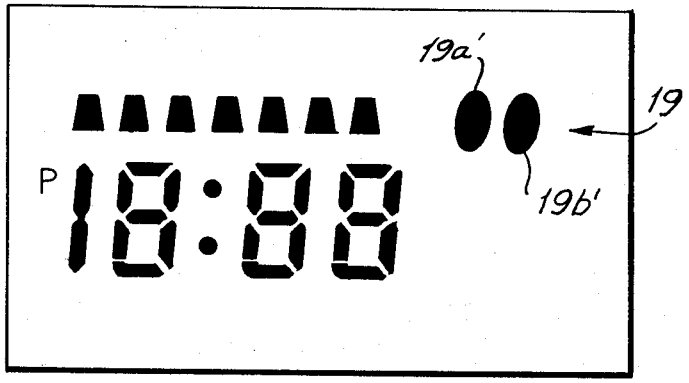
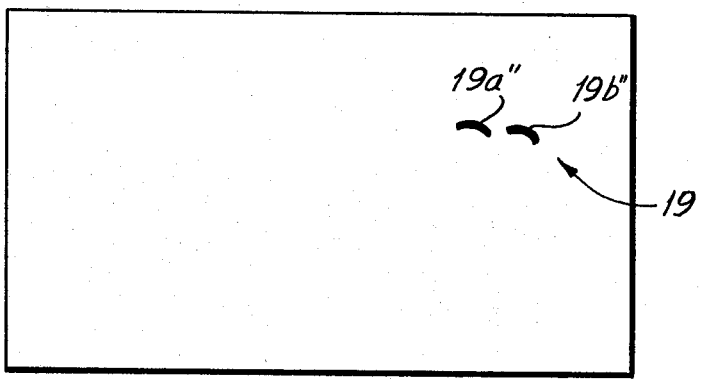
FIG. 5

FIG. 6
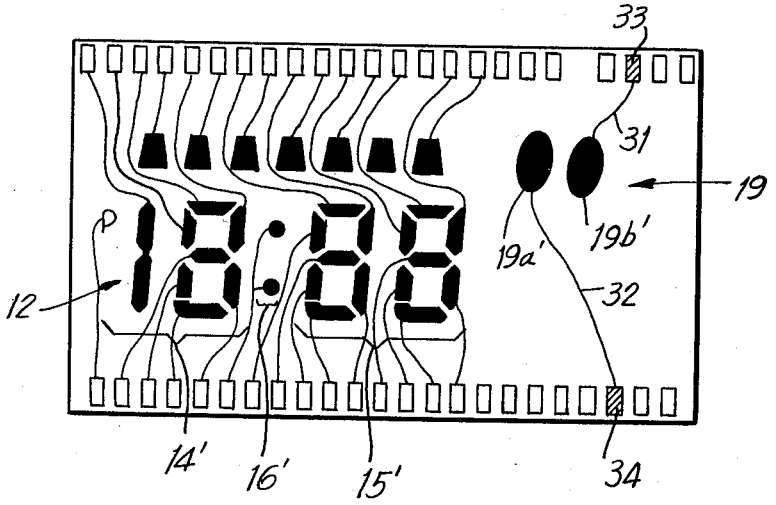
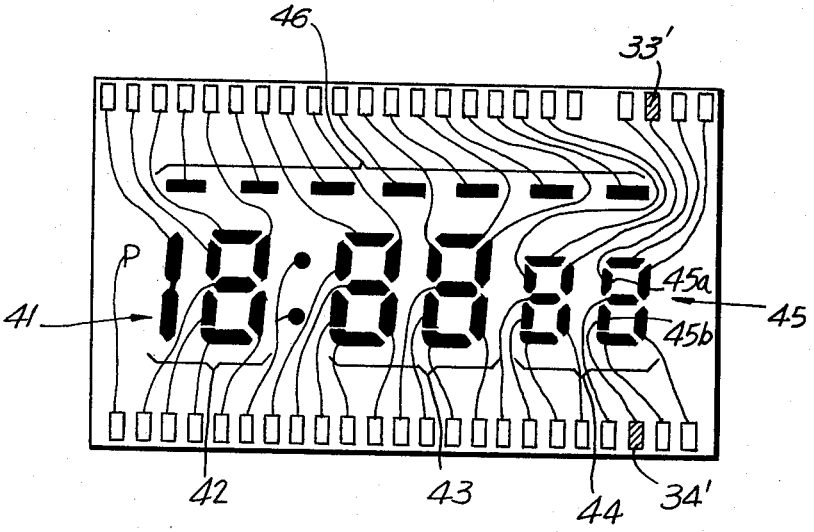
FIG. 7

ELECTRONIC TIMEPIECE INCLUDING AN ANIMATED DISPLAY

BACKGROUND OF THE INVENTION

This invention relates generally to an electronic timepiece, and particularly to an electronic timepiece including an animated display portion.

Conventional electronic timepieces providing only timekeeping functions generally only display additional displays of timekeeping information for indicating years, months, days and dates. Alternatively, such timekeeping functions as a chronograph, alarm function, counter function or the like in addition to the basic display of actual time in hours, minutes and seconds may also be provided. At times, it may also be desirable to provide additional display functions, such as an animated display function which is entirely independent of the above-mentioned timekeeping displays. When doing so, it is desirable to do so without taking away from the advantages in design and construction of conventional electronic timepieces.

SUMMARY OF THE INVENTION

Generally speaking, in accordance with the invention, an electronic timepiece including an animated display is provided. The timepiece includes a timekeeping circuit for generating timekeeping signals in actual time and a display region driven by the actual timekeeping signals. In addition, the timepiece includes an animated display region including flickering display elements which are driven completely independent of the actual timekeeping display region.

When the electronic timepiece display is a liquid crystal display, a pattern or picture forming the animated region is provided on the lower surface of the timepiece transparent cover plate. Flickering display elements are included within the pictorial or pattern for providing the animation effect. The flickering elements of the animated display region may be electrically connected to segment display terminal for being driven by timekeeping signals generated by a timekeeping counter and corresponding driver in the timepiece timekeeping circuit. Accordingly, the animated display portion is driven independent of the display of normal timekeeping functions which may include time and actual time, chronograph function or counter function, as desired.

By connecting a flickering display including at least two flickering elements of the animated display to the segment display terminals of a timepiece counter, the flickering element may be sequentially displayed through a flickering pattern which is repeated after a selected time interval. This animated display will be repeated sequentially during a time interval depending on the time unit of the signals selected for driving the flickering display elements in the animated display region.

Accordingly, it is an object of the invention to provide an improved electronic timepiece.

Another object of the invention is to provide an improved electronic timepiece including an animated display.

A further object of the invention is to provide an electronic timepiece having a timekeeping display region and an animated display region driven entirely independent of the timekeeping display region.

Still another object of the invention is to provide an electronic timepiece including an animated display driven by driving signals generated by a timekeeping counter of the timepiece timekeeping circuitry.

Yet another object of the invention is to provide an improved electronic timepiece including an animated display region wherein the animated display includes flickering display elements repetitively driven through a flickering display sequence.

Still other objects and advantages of the invention will in part be obvious and will in part be apparent from the specification.

The invention accordingly comprises the several steps and the relation of one or more of such steps with respect to each of the others, and the article possessing the features, properties, and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 4 is a plan view illustrating the display of the timepiece of FIGS. 1 and 2 wherein all display electrode segements of the display are driven;

FIG. 5 is a plan view illustrating the display of the timepiece of FIGS. 1 and 2 wherein none of the display electrodes segments are driven;

FIG. 6 is a plan view of the electrode configuration or a wiring diagram of the display electrodes of the display of the timepiece illustrated in FIGS. 1 and 2;

FIG. 7 is an electrode pattern or wiring diagram of display of a conventional liquid crystal display pattern for a timepiece;

DESCRIPTION OF THE PREFERRED EMBODIMENTS

Figure 1:
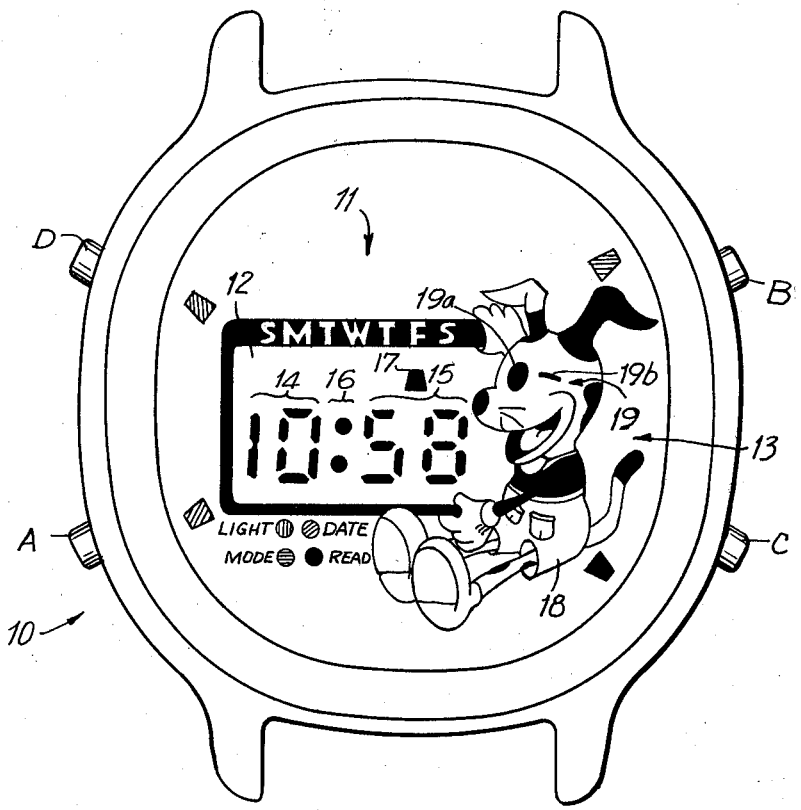
FIG. 1 is a plan view of a timepiece including an animated display portion constructed and arranged in accordance with the invention.

Referring now to FIG. 1, a plan view of an electronic timepiece shown generally as 10 and including an animated display constructed and arranged in accordance with the invention is shown. Timepiece 10 includes a display portion 11 which includes a time display region 12 for display of timekeeping functions and an animated display region 13. In the embodiment illustrated, time display 10 includes a display of actual time in hours 14 and a display of time in minutes 15 separated by a colon 16 and a day of week display 17.

Antimated display portion 13 of display 11 includes a pattern 18. In the embodiment illustrated, pattern 18 represents an animal character holding a sign or the like including time display 12, but it is clearly contemplated within the invention to encompass a variety of designs. Pattern 18 includes two flickering display elements 19 for performing the animation function of animated dislay region 13 as will be described in more detail below. A first flickering display element 19*a* and a second flickering display element 19*b* represent the right and left eyes, respectively, of the character.

Figure 2:
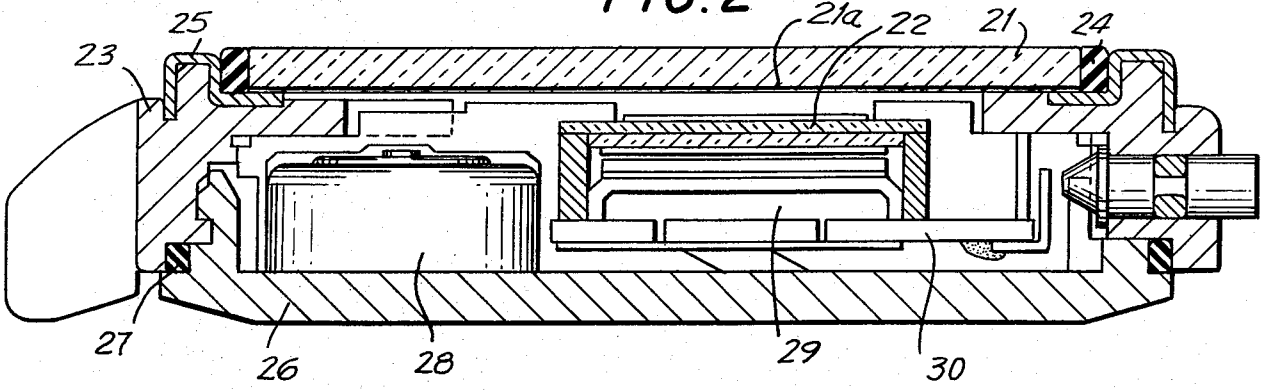
FIG. 2 is a cross-sectional view of the timepiece illustrated in FIG. 1.

Referring now to FIG. 1 and FIG. 2, in the embodiment illustrated and discussed herein, electronic timepiece 10 is a liquid crystal display timepiece including a liquid crystal display 22. Time display 12 in the embodiment illustrated in FIG. 1 displays actual time, for example 10:58 A.M. on Friday as illustrated time display 12 in FIG. 1. Pattern 18 corresponding to the figure represented is printed on the lower surface 21*a* of cover plate 21. Flickering display elements 19*a* and 19*b* representing the eyes of the figure are provided in liquid crystal display cell 22 in accordance with the description which follows. Flickering display elements 19 are displayed in the following repetitive cycle of FIG. 1 corresponding to, for example, the digit representing seconds.

TABLE I

| Digit | Right Eye | Left Eye | Digit | Right Eye | Left Eye |
|---|---|---|---|---|---|
| 0 | 0 | 0 | 5 | — | 0 |
| 1 | — | — | 6 | 0 | 0 |
| 2 | 0 | — | 7 | — | — |
| 3 | — | — | 8 | 0 | 0 |
| 4 | — | 0 | 9 | — | 0 |

Timepiece 10, as illustrated in FIG. 2, is of conventional construction wherein a cover glass 21 is retained within a timepiece frame 23 by a gasket 24 and a holding clip 25. A case back 26 is releaseably secured within watch frame 23 and includes a gasket 27 for providing a secure fit therebetween. Timepiece 10 is powered by a battery 28 and the timepiece timekeeping circuitry is mounted in an integrated circuit 29 positioned on a printed circuit substrate 30 below liquid crystal display cell 22. The timepiece functions and displays are operated by buttons A, B and C in conventional fashion as will be described in more detail below. A fourth button D is also provided for providing a light for assisting in viewing the display in darkened ambient conditions.

Figure 3:
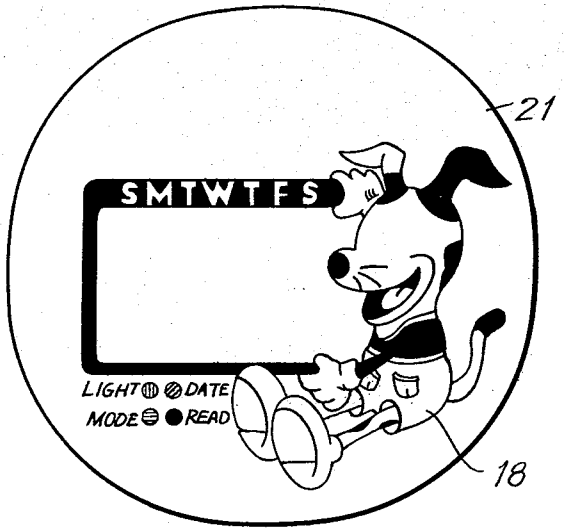
FIG. 3 is a plan view of the cover glass of the timepiece illustrated in FIGS. 1 and 2.

FIG. 3 is a plan view of cover plate 21 showing printed pattern 18 described in connection with FIG. 1. Pattern 18 is printed on lower surface 21*a* of cover plate 21. A clear pattern is printed in outline form so there is no printing in the region in cover plate 21 corresponding to the position of flickering display elements 19. This will permit clear vision of the animation effect of animated display portion 13.

Referring to FIGS. 4 and 5, plan views illustrating the various conditions of display of liquid crystal display cell 22 are shown. FIG. 4 illustrates the condition of the display where all display element segements of liquid crystal display 22 are driven. In this condition, flickering display elements 19 appear as darkened oval regions—as opened eyes of the animal character and are designated by reference numerals 19*a*′ and 19*b*′. FIG. 5 illustrates the condition of the display when none of the display element segments of liquid crystal display 22 are driven. In this condition, flickering display elements 19 of the animated display are shown as slits—represented as the closed eyes of the animal character and are designated by reference numerals 19*a*″ and 19*b*″. As can be seen from FIGS. 4 and 5, patterns 19*a*″ and 19*b*″ which forms a part of pattern 18 are printed on the upper surface of liquid crystal display cell 22.

In accordance with the invention, patterns 19*a*″ and 19*b*″ representing the closed eyes of the animal character are matched with the liquid crystal display elements 19*a*′ and 19*b*′ representing the opened eyes of the animal character of animated display portion 13. It is necessary to provide pattern elements 19*a*″ and 19*b*″ in the same color as liquid crystal display elements 19*a*′ and 19*b*′ so that printed elements 19*a*″ and 19*b*″ will register with liquid crystal display elements 19*a*′ and 19*b*′ and appear out of sight when liquid crystal display elements 19*a*′ and 19*b*′ flicker in accordance with the display sequence of TABLE I. Accordingly, this will yield the effect as if the eyes of the animal character themselves were opening and closing by matching printed patterns 19*a*″ and 19*b*″ with liquid crystal display segments 19*a*′ and 19*b*′. The remaining liquid crystal display element segments illustrated in FIG. 4 are selectively driven for providing time display 12 in the usual manner. Accordingly, the manner in which the liquid crystal display is driven for displaying actual time need not be described in detail herein.

The method for driving flickering display elements 19 of animated display region 13 will be described in connection with FIGS. 6 and 7. FIG. 6 illustrates a wiring diagram or electrode configuration for the display elements of liquid crystal display cell 22 of timepiece 10. As shown in FIGS. 1 and 4, time display region 12′ includes two segmented digits for displaying time in hours 14′, two seven segment display characters for displaying time in minutes 15′ separated by colon 16′ and two flickering display elements 19. Flickering liquid crystal display elements 19*a*′ and 19*b*′ are shown electrically connected by a pair of transparent lead wires 32 and 31, respectively, to a pair of selected terminals 33 and 34.

FIG. 7 illustrates a wiring diagram 41 for electrode segments in a conventional liquid crystal display panel used for indicating time in hours 42, minutes 43, seconds 44 and day of week 46. Each of the transparent electrode display segments is electrically connected to a selected terminal in the wiring diagram illustrated. A unit digit 45 of seconds display 44 is shown wherein the upper segment 45*a* and lower segment 45*b* on the left-hand side of digit 45 are connected to terminals 33′ and 34′ which correspond to terminals 33 and 34 connected to flickering liquid crystal display segments 19 in FIG. 6.

In accordance with this embodiment of the invention, flickering liquid crystal display elements 19*a*′ and 19*b*′ of animated display region 13 are electrically connected to two segment terminals 33 and 34 which respectively correspond to segments 45*a* and 45*b* of unit seconds digit 45 in FIG. 7. In other words, terminals 33 and 34 of a general timekeeping liquid crystal display timepiece may be used for performing the animation display in accordance with the invention. Each display element in the animation pattern during a selected time interval will follow the sequence of TABLE I where the corresponding animation display condition is shown corresponding to the displayed number of seconds digit 45 in time display 41. Thus, when terminals 33 and 34 are electrically connected to a seconds driver in the timekeeping circuitry (not shown) and a signal for the seconds display is applied to segments 19*a* and 19*b*, an animated display timepiece including this new function compared with a conventional timepiece, is provided. In accordance with this embodiment of the invention, an animated display can be easily provided by modifying a liquid crystal display panel as shown in FIG. 5 and by printing a pattern on a cover glass as shown in FIG. 3. It is not necessary to describe in detail herein of the reasons why segments 45*a* and 45*b* have been selected from the seven segments of seconds display 44. Suffice it to say that elements 45*a* and 45*b* of seconds unit digit 44 are alternatively driven the largest number of times for providing increased flickering during the selected time interval.

Figure 8:
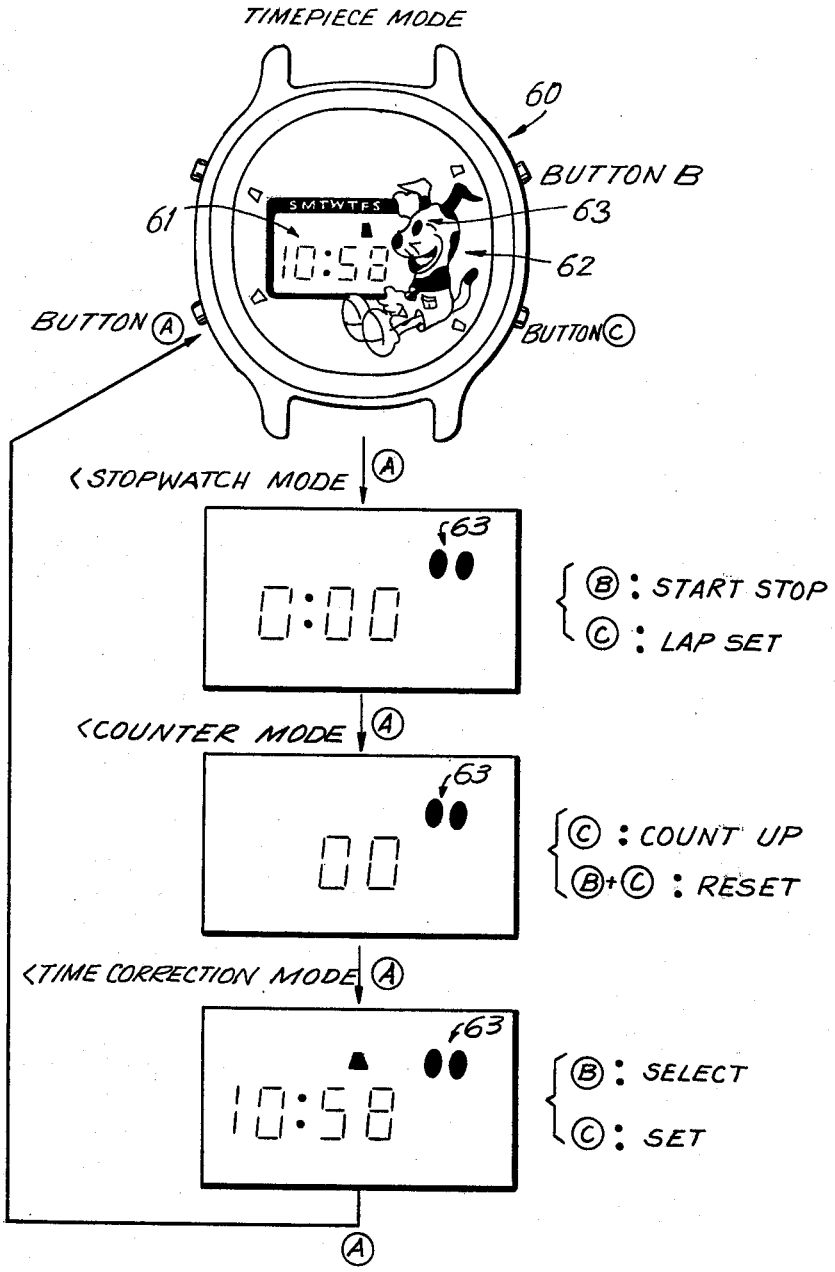
FIG. 8 is a plan view and schematic representation of the display in the timepiece of FIGS. 1 and 2 in various modes in accordance with the invention.

A timepiece constructed and arranged in accordance with the invention may also include a stop watch or chronograph function and counter functions in addition to a timekeeping display of actual time. Operation of such a timepiece including these additional functions is shown in FIG. 8. As these functions and displays are well known, only a general statement in connection therewith will be presented herein. Referring specifically to FIG. 8, a timepiece 60 including a display of actual time 61 and an animated display region 62 is shown. Display of actual time is generally limited to a display of hours, minutes and day of week. For example, 10:58 AM on Friday is indicated. When mode button A is actuated repetitively, timepiece 60 is placed in a stopwatch mode, a counter mode and a time correction mode as shown and described in U.S. Pat. No. 4,207,731 to Hidehiko Seki and issued on June 17, 1980 and assigned to the same assignee as this invention.

When timepiece 60 is in the stopwatch mode, operation button B starts or stops the elapsed time counter in the timepiece circuitry and operation of button C records lap time or resets the laps time counter. When timepiece 60 is placed in a counter mode, display 61 may count up from 00 to 99 by using the display for the minutes display by operating button C. Reset is performed by actuating button B and button C simultaneously. When timepiece 60 is placed in a time correction mode, a digit to be corrected is selected by operation of button B and the time correction of a digit is performed by operation of button C which indexes the counter associated with the selected digit. As noted, operation in these various modes is well known in the timekeeping art.

When timepiece 60 is placed in the various modes by operation of button A, animated display 62 functions as follows. As noted above, when in the timekeeping mode, the eyes 63 of the animal character of animated display 62 provides a display as indicated in TABLE I each second, corresponding to the seconds digit. Of course, in this case, the flickering liquid crystal display elements representing the eyes of the animal character are electrically connected and driven by the seconds counter of the timepiece circuitry. When timepiece 60 is placed in a stop watch mode, actuation of button B starts elapse time measurement and animated display 62 is displayed at intervals of 1/10 seconds. This display occurs in the display order shown in TABLE I. Similarly when timepiece 60 is displaced in a counter mode, animated display 62 is displayed by each push operation of button B. This also occurs in the display order of TABLE I.

Figure 9:
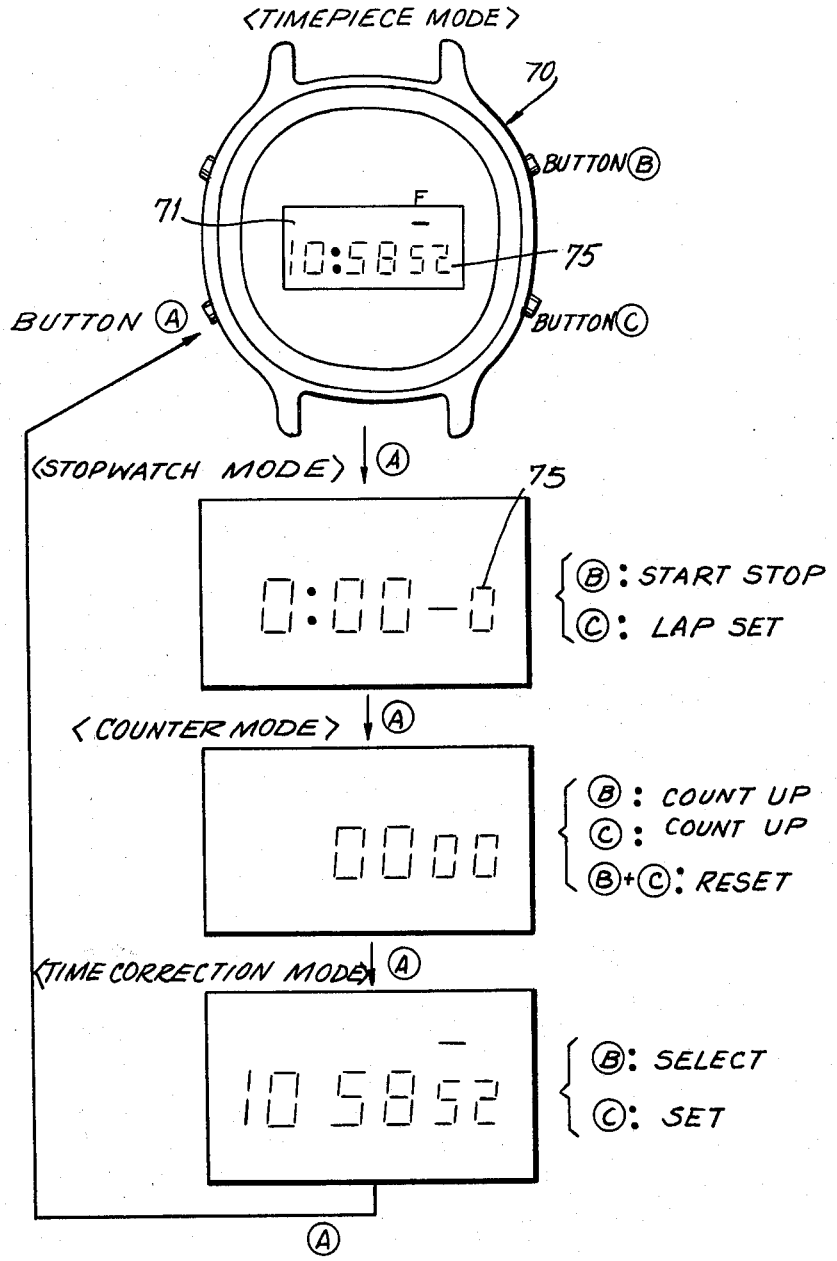
FIG. 9 is a plan view of a conventional liquid crystal display timepiece and schematic representation of the display in various timekeeping modes.

Functioning of animated display 62 may be explained by comparing operation of the display of timepiece 60 with a conventional liquid crystal display timepiece for displaying hours, minutes, seconds and day of the week as illustrated by a timepiece 70 in FIG. 9. Timepiece 70 includes a liquid crystal display 71 shown in a display of actual time. The time shown in liquid crystal display 71 is 10:58.52 AM on a Friday.

When timepiece 70 is placed in a stopwatch mode by operation of mode button A, elapsed time is measured and displayed by intervals of 1/10 seconds by display digit 75. By selecting two segments of display character 75 as described above in connection with FIGS. 6 and 7, the flickering liquid crystal display elements 63 of the eyes of the animal character of animated display 62 will flicker at intervals of 1/10 seconds in the display order of TABLE I. Similarly, when timepiece 70 is placed in a counter mode which counts up from 00 to 99, the corresponding count-up display applied to flickering liquid crystal display elements 63 of animated display 62 also will be displayed in the order shown in TABLE I. This will occur at each count-up signal.

While it is not necessary for an understanding of the invention, the counter function display of timepiece 60 in FIG. 8 may be performed at the region of animated display 62 and the minute display region of display 61 as there are various ways of providing a counter function in a timepiece. This includes a single counter function and a twin counter function. A single counter function provides a display from 0000 to 9999 by operation of button B. In a twin counter function, two figures are counted, each from 00 to 99 which are displayed by operation of button B and button C.

Accordingly, as described herein, an electronic timepiece constructed and arranged in accordance with the invention provides a timepiece having an animated display region which is different than the conventional displays of electronic timepieces. Clearly, this falls under a new category for providing a new display effect. Such an animated display in accordance with the invention can be readily included in a timepiece including various conventional display functions. Additionally, the flickering and the speed of animation may be changed in the various timekeeping modes such as display of actual time, a chronograph display or a counter display in accordance with the preference of the user. Further, the animated display may be easily included in a conventional timepiece having various functions.

In this specification, only an example wherein the animation portion is corresponding to the eyes of an animal character is shown for the purpose of illustrative description. It is of course within the scope of the invention to adapt the animated display to any portion of a wide variety of electrode patterns, based on the same driving method described above.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An animated display electronic timepiece comprising:

a timepiece circuit including means for generating at least timekeeping signals representative of actual time and drive means for driving a timepiece display;

a liquid crystal timepiece display including display elements for displaying time in response to said timekeeping signals, said display being a liquid crystal display cell having two opposed and spaced apart transparent plates and transparent electrode means disposed thereon with a liquid crystal material in the space therebetween, selected regions of said liquid crystal material being rendered visually distinguishable from the remaining material upon application of a potential across said liquid crystal material, the display including transparent cover means disposed in registration with said display cell for viewing said display;

a time display region in said timepiece display for selectively displaying time in at least hours and minutes; and an animated display region in said timepiece display including a pattern including at least one flickering display means and a permanent indicia disposed on said display cell being of less area and in optical registration with the flickering display means, the remainder of said pattern being permanent and disposed on said transparent means, the animation effect provided in response to flickering of said display means so that the permanent indicia on said display cell is viewable when the flickering display means is not rendered visually distinguishable from the remaining liquid crystal material, and said permanent indicia is not separately viewable from the flickering display element when the flickering display means is rendered visually distinguishable from the remaining liquid crystal material in response to signals from said timepiece circuit.

2. The electronic timepiece of claim 1, wherein said animated display region includes at least two flickering display elements and two permanent indicia on the display cell in optical registration with said two display elements for providing the animation effect.

3. The electronic timepiece of claims 1 or 2, wherein said timekeeping circuit includes means for generating timekeeping signals in seconds and said at least one flickering display element of said animated display region is driven in response to said seconds timekeeping signals.

4. The timepiece of claim 1, wherein said timekeeping circuit includes means for generating timekeeping signals in seconds and said timekeeping display includes terminal regions for providing connections to said timekeeping circuit means for receiving said timekeeping drive signals and said timekeeping display includes display elements for providing a segmented character display and said at least one flickering display element of said animated display region is connected electrically to the terminal regions corresponding to selected segment terminals of a character display of seconds.

5. The electronic timepiece of claim 4, wherein the animated display represents an animal character and said flickering display elements are disposed in the position of the eyes of said animal character wherein each of said flickering display regions changes from a first eye open position to a second eye closed position in response to signals corresponding to the segment of the seconds digit of the liquid crystal display.

6. The electronic timepiece of claim 5, wherein said eye closed display of said flickering display elements is disposed on the outer region of said timekeeping display in a color corresponding to the display of an eye open display element whereby the eyes of the animated character appear to change from open to closed in response to said timekeeping drive signals applied to the display elements.

7. The electronic timepiece of claim 6 wherein said timepiece display is a liquid crystal display.

8. The electronic timepiece of claim 2 or 6 wherein said timekeeping circuit means is adapted to be disposed in a plurality of timekeeping functional modes for performing at least one timekeeping function in each said mode.

9. The electronic timepiece of claim 8, wherein said functional modes includes a stopwatch counter for producing elapsed time signals when in a stopwatch mode.

10. The electronic timepiece of claim 9, wherein said functional modes includes manually operated switch means for generating counter signals and count-up means for counting said counter signals.

11. The electronic timepiece of claim 1, wherein the flickering of said at least one display element in the animated display region is driven in response to timekeeping signals generated by said timepiece circuit.

* * * * *